US006278858B1

(12) United States Patent
Nakazawa et al.

(10) Patent No.: US 6,278,858 B1
(45) **Date of Patent: *Aug. 21, 2001**

(54) IMAGE FORMING APPARATUS HAVING AN INTERMEDIATE TRANSFER MEMBER AND METHOD OF FORMING AN IMAGE USING THE INTERMEDIATE TRANSFER MEMBER

(75) Inventors: Akihiko Nakazawa, Shizuoka-ken; Toshio Takamori, Numazu; Takashi Kusaba, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,094

(22) Filed: May 19, 1998

(30) Foreign Application Priority Data

May 20, 1997 (JP) ..... 9-130018

(51) Int. Cl.[7] ..... G03G 15/01; G03G 15/16
(52) U.S. Cl. ..... 399/302; 399/308
(58) Field of Search ..... 399/159, 231, 399/297, 302, 308

(56) References Cited

U.S. PATENT DOCUMENTS

| | | | | |
|---|---|---|---|---|
| 5,666,193 | * | 9/1997 | Rimai et al. | 399/308 |
| 5,715,501 | * | 2/1998 | Aita et al. | 399/159 |
| 5,715,510 | * | 2/1998 | Kusaba et al. | 399/308 |
| 5,761,594 | * | 6/1998 | Seto et al. | 399/302 |
| 5,774,771 | * | 6/1998 | Kukimoto et al. | 399/302 X |
| 5,797,070 | * | 8/1998 | Waki et al. | 399/231 X |

FOREIGN PATENT DOCUMENTS

| | | |
|---|---|---|
| 0 715 229 | 6/1996 | (EP) . |
| 0 738 938 | 10/1996 | (EP) . |
| 0 752 628 | 1/1997 | (EP) . |
| 56-153357 | 11/1981 | (JP) . |
| 63-301960 | 12/1988 | (JP) . |
| 1-105980 | 4/1989 | (JP) . |
| 4-340564 | 11/1992 | (JP) . |
| 5-297739 | 11/1993 | (JP) . |
| 5-303310 | 11/1993 | (JP) . |
| 6-175510 | 6/1994 | (JP) . |
| 7-234592 | 9/1995 | (JP) . |
| 8-211757 | 8/1996 | (JP) . |
| 8-248776 | 9/1996 | (JP) . |
| 8-320591 | 12/1996 | (JP) . |
| 9-106194 | 4/1997 | (JP) . |
| 9-230717 | 9/1997 | (JP) . |

* cited by examiner

*Primary Examiner*—Fred L. Braun
(74) *Attorney, Agent, or Firm*—Fitzpatrick, Cella, Harper & Scinto

(57) ABSTRACT

An image performing apparatus and method for forming an image using a first image holding member and an intermediate transfer member for holding by primary transfer a toner image formed on the first image holder and for retransferring by secondary transfer the transferred toner image onto a second image holding member, wherein a contact angle between a surface layer of an intermediate transfer member and water is 50° to 120° and transfer-promoting particles are loaded onto the surface layer.

42 Claims, 5 Drawing Sheets

IMAGE FORMING APPARATUS HAVING AN INTERMEDIATE TRANSFER MEMBER AND METHOD OF FORMING AN IMAGE USING THE INTERMEDIATE TRANSFER MEMBER

BACKGROUND OF THE INVENTION

1. Field of the Invention

The present invention relates to an image forming apparatus, an image forming method, and an intermediate transfer member using an electrophotographic process. In particular, the present invention relates to an image forming apparatus, an image forming method, and an intermediate transfer member, in which a toner image formed on a first image holding member is transferred onto an intermediate transfer member and then retransferred onto a second image holding member.

2. Description of the Related Art

Image forming apparatuses having intermediate transfer members have the following advantages compared with image forming apparatuses that perform a direct transfer of an image from a first image holding member onto a second image holding member which is gripped or adsorbed onto a transfer drum (as described in, for example, Japanese Patent Laid-Open No. 63-301960). There will not be any significant registration occur when different color images are overlapped; and the selection of possible materials and the shapes of the second image holding member have high versatility since it can be used without additional treatment and control, for example, being fixed with a gripper, by adsorption, or by curling itself. For example, a usable second image holding member ranges from a thin paper sheet of 40 $g/m^2$ to a thick paper sheet of 200 $g/m^2$. Further, its length and width are not limited. Envelopes, postcards and labels can therefore be used as a second image holding member. Full-color copying machines and printers provided with intermediate transfer systems having such advantages are spreading.

The recent rapid spread of image readers for personal computers, digital cameras and image scanners has led to a great demand for full-color printers and copying machines. These printers and copying machines must be applicable to a variety of users and environments. Other requirements are that the costs of producing, operating and maintaining are low, that maintenance is easy, that the apparatus itself is miniaturized, and that stability of the image quality is not affected by environmental factors, such as temperature and humidity.

Key factors for satisfying such requirements are the characteristics involved in transferring images from an intermediate transfer member to a second image holding member such as a paper sheet (hereinafter the transfer is referred to as secondary transfer), and cleaning characteristics of a developer remaining on the intermediate transfer member after the secondary transfer. The cleaning characteristics greatly affect the life of the intermediate transfer member, the configuration of the apparatus body, and the maintenance operation. Further, the transfer characteristics greatly affect the quality of the image and la the cleaning operation. The transfer characteristics will deteriorate significantly under a high-temperature, high-humidity environment.

A means for improving the transfer characteristics is disclosed in Japanese Patent Laid-Open No. 7-234592, in which fine particles being less than half the size of toner particles, are fixed onto the elastic surface of the intermediate transfer member in order to improve releasability. In Japanese Patent Laid-Open No. 9-230717, an intermediate transfer member which is coated with beads having a certain diameter is disclosed. Other means include the formation of a coating layer composed of water-repellent resin and the use of a water-repellent resin belt. Another means for improving the transfer characteristics is to use a copying machine provided with a coating unit which applies a lubricant onto the intermediate transfer member as disclosed in Japanese Patent Laid-Open No. 8-248776.

None of these means, however, have a countermeasure to the deterioration of transfer characteristics under high-temperature, high-humidity environments.

SUMMARY OF THE INVENTION

Accordingly, it is an object of the present invention to provide an image forming apparatus, an image forming method, and an intermediate transfer member having excellent transfer characteristics under high-temperature, high-humidity environments from the beginning of use.

It is another object of the present invention to provide an image forming apparatus, an image forming method, and an intermediate transfer member having a prolonged life and a capability of reducing the operational costs.

It is a further object of the present invention to provide an image forming apparatus, an image forming method, and an intermediate transfer member permitting simplified body configuration, improved maintenance, and high-speed printing.

A first aspect of the present invention is an image forming apparatus including a first image holding member, and an intermediate transfer member for holding by primary transfer a toner image formed on the first image holding member and for retransferring by secondary transfer the transferred toner image onto a second image holding member, wherein the contact angle between the surface layer of the intermediate transfer member and water is 50° to 120°, and transfer-promoting particles are loaded onto the surface layer.

A second aspect of the present invention is an image forming method including the following steps of a primary transfer of a toner image from a first image holding member onto an intermediate transfer member having a contact angle to water of 50° to 120° and having a surface layer provided with transfer-promoting particles loaded thereon, and a secondary transfer of the transferred toner image onto a second image holding member.

A third aspect of the present invention is an intermediate transfer member for holding by primary transfer a toner image formed on a first image holding member, and for retransferring by secondary transfer the transferred toner image onto a second image holding member, comprising a surface layer having a contact angle to water of 50° to 120°, and transfer-promoting particles loaded onto the surface layer.

Further objects, features and advantages of the present invention will become apparent from the following description of the preferred embodiments with reference to the attached drawings.

DESCRIPTION OF THE PREFERRED EMBODIMENT

Figure 1:
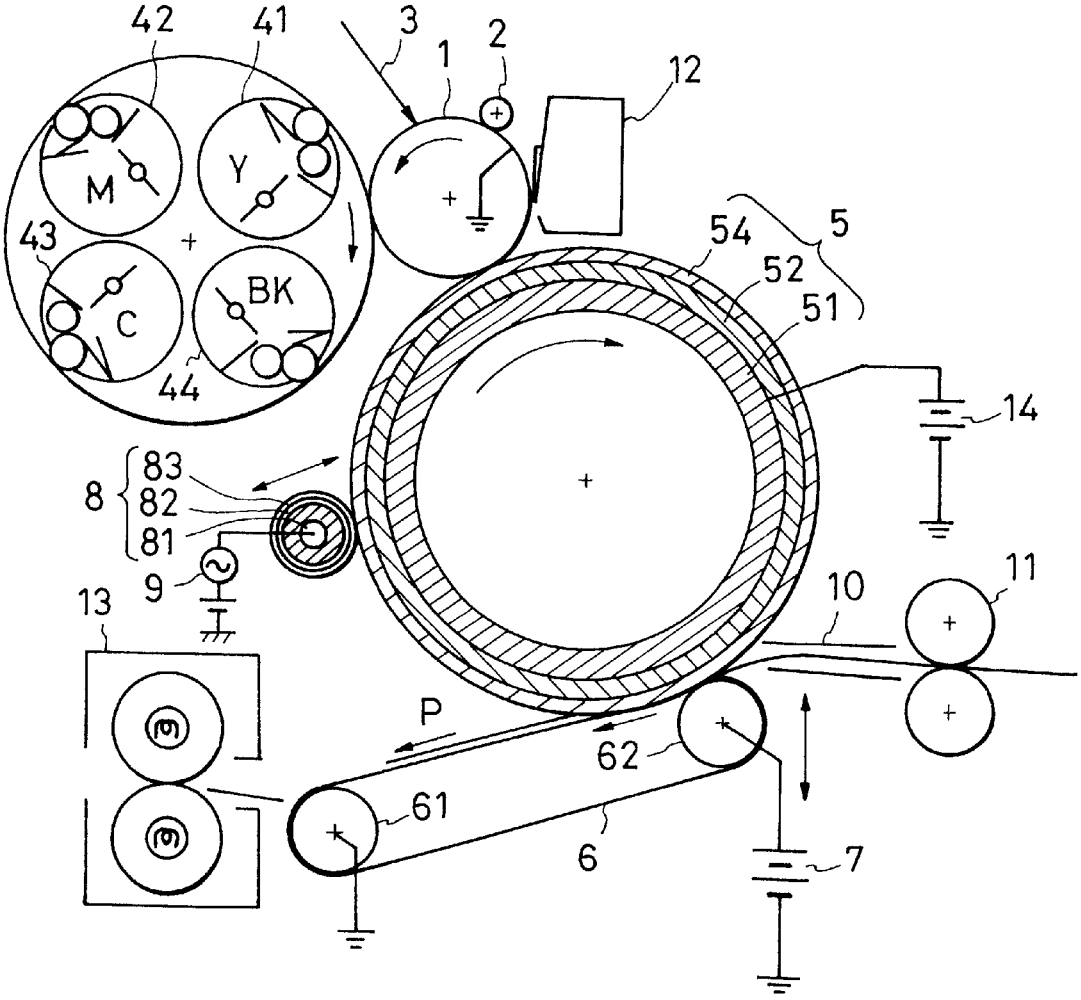
FIG. 1 is an outlined cross-sectional view of an image forming apparatus provided with a roller-type intermediate transfer member in accordance with the present invention.

The image forming apparatus in accordance with the present invention includes a first image holding member, and an intermediate transfer member for holding by primary transfer a toner image formed on the first image holding member and for retransferring by secondary transfer the transferred toner image onto a second image holding member, wherein the contact angle between the surface layer of the intermediate transfer member and water is 50° to 120°, and particles are loaded onto the surface layer.

Reduction in adhesiveness of the toner on the intermediate transfer member is effective for improving secondary transfer characteristics. Such an improvement is achieved by an intermediate transfer member having a highly lubricative surface with high releasability, as described above. Continuous printing operations under high-temperature, high-humidity environments, however, require further improved transfer characteristics which are not always achieved by the above-mentioned surface releasability.

In the present invention, transfer-prompting particles are loaded on the surface layer of the intermediate transfer member having high releasability so that transfer characteristics and thus cleaning characteristics are significantly improved by synergistic effects. Although the effects are not clarified, it is presumed as follows. The particles can move without restrictions by the toner or the intermediate transfer member. Further, the particles intervene between the toner and the intermediate transfer member so as to reduce the contact area thereof. As a result, adhesiveness of the toner to the intermediate transfer member is significantly reduced, resulting in significantly improved transfer characteristics.

Essential features in the present invention are both of a high surface releasability of the intermediate transfer member and the presence of the transfer-prompting particles. If one of these features is lacking, the advantages intended in the present invention cannot be achieved. It is important that the particles can move to some extent on the intermediate transfer member. If a part of or all of the particles are fixed to the intermediate transfer member by, for example, being embedded into the intermediate transfer member, these particles do not function as the transfer prompter. Thus, the particles disclosed in the above-mentioned Japanese Patent Laid-Open No. 7-234592 and beads disclosed in Japanese Patent Laid-Open No. 9-230717 do not function as the transfer-prompting particles in the present invention. In the Japanese Patent Laid-Open No. 7-234592, there is the following description, that is, the particles are strongly fixed to the intermediate transfer member and are hardly removed by wiping with cloth using an alcoholic solvent, and the intermediate transfer member can be reused after cleaning. In the Japanese Patent Laid-Open No. 9-230717, there is a description that the beads can not be readily dislodged from the intermediate transfer member during the transfer and cleaning operation. These particles and beads are therefore fixed to the surface of the intermediate transfer member as a releasability improver, functioning quite differently from the transfer-prompting particles in accordance with the present invention.

In accordance with the present invention, the contact angle between the surface layer of the intermediate transfer member and water ranges from 50° to 120°, and preferably 60° to 110°. A contact angle of less than 50° causes deteriorated secondary transfer characteristics. Particularly, the intermediate transfer member adsorbs a large amount of water on its surface under high-temperature, high-humidity environments. As a result, secondary transfer characteristics and cleaning characteristics deteriorate significantly, resulting in image defects and a decreased throughput. A contact angle of higher than 120° causes unsatisfactory loading of the transfer-prompting particles onto the surface of the intermediate transfer member, resulting in deterioration of secondary transfer characteristics and cleaning characteristics. Further, it is difficult to produce an intermediate transfer member having such a contact angle. The contact angle can be determined with a goniometer made by Kyowa Interface Science Co., Ltd.

The transfer-prompting particles in accordance with the present invention have a weak bonding force such that when an adhesive tape with an adhesive force of 180 to 220 gf/cm is adhered to and then detached from the intermediate transfer member loading the particles, 30% to 95% and preferably 40% to 90% of the particles are removed from the surface of the intermediate transfer member. A percentage of less than 30% means strong adhesion of the transfer-promoting particles to the intermediate transfer member which inhibits secondary transfer of the toner. On the other hand, a percentage of greater than 95% means insufficient adhesive force, and a large amount of transfer-promoting particles migrate to the secondary transfer members, such as paper in a short time, resulting in unsatisfactory fixing, uneven images, and deterioration of cleaning characteristics.

The method for determining the adhesive force of the transfer-promoting particles in accordance with the present invention will be described in more detail. An adhesive tape used in the method has an adhesive force of 180 to 220 gf/cm by JIS Z00237 (a 180° peeling method). The adhesive tape is adhered to the surface of the intermediate transfer member loading transfer-promoting particles, repeatedly pressurized with a roller, and allowed to stand for 10 minutes. The adhesive tape is peeled from its one end in the direction of 180° to the adhesive tape at a speed of 300 mm/s so as to detach the adhesive tape from the intermediate transfer member. Five cut pieces are prepared from the peeled section of the intermediate transfer member, and the numbers of transfer-promoting particles per unit area are counted by an enlarged screen of a scanning electron microscope (SEM). Also, five cut pieces are prepared from the section in which the adhesive tape is not adhered (non-adhesion section), and the particle numbers are similarly counted. The magnification and the observed area of the SEM depend on the size and the number of transfer-promoting particles, and are determined such that at least 100 particles are counted for the cut piece from the non-adhesion section.

The removal rate of the particles is calculated by the following equation using a mean value of each number:

$$\text{Removal rate } (\%) = (A-B)/A \times 100$$

wherein A represents the number of particles at the position of the intermediate transfer member in which peeling by the tape is not carried out, and B represents the number of particles at the position in which the peeling is carried out.

When a large number of particles are stacked to form many layers, a sufficient amount of particles cannot removed only by one peeling process. The peeling process therefore is repeated before almost the particles are removed from the surface of the intermediate transfer member by adhesive force of the tape. The peeling process is completed when the number of particles adhered to the tape is one-tenth or less the number of particles adhered to the first tape.

The numbers of adhered particles per unit area in all the peeled tapes were determined with the SEM as in the above-mentioned process. The total number of the particles is defined as the particle number. Further, a part of the intermediate transfer member is cut to observe the number of the remaining particles with the SEM. The removal rate is determined by the following equation:

$$\text{Removal rate}=(T_1+T_2+T_3+\ldots+T_x)/T_1+T_2+T_3+\ldots+T_x+B)\times 100$$

wherein each of $T_1$ to $T_x$ represents the number of particles adhered to the tape, the suffix x represents the number of the peeling processes, and B is the same as above.

When particles are present as agglomerates, the total number of particles is determined as follows. The maximum length and the minimum length of an agglomerate particle are determined by SEM observation, and all agglomerates in the observed SEM field are subjected to the measurement. A reduced diameter of a particle is calculated from the average of the maximum length and the minimum length, and then a mean reduced diameter of all the agglomerates is calculated. The total number of particles in all the agglomerates is calculated based on the mean reduced diameter.

It is preferable that the diameter of the transfer-promoting particles be within a range from 0.001 $\mu$m to 3 $\mu$m. and more preferably not larger than 1 $\mu$m, and more preferably from 0.005 $\mu$m to 1 $\mu$m in the present invention. Particles having a diameter of larger than 3 $\mu$m do not cover the surface layer uniformly, resulting in uneven image and hollow character. Particles having a diameter of less than 0.001 $\mu$m do not satisfactorily function as transfer-promoting particles, resulting in deterioration of transfer characteristics. The diameter of the particles is determined as follows. The objective particles in an amount of approximately 0.5 percent by weight are mixed with polyethylene particles having a diameter of approximately 10 $\mu$m by a dry process so that the objective particles are adhered onto the surfaces of the polyethylene particles. These objective particles are observed with a SEM at a magnification of 30,000. The mean diameter is calculated from the maximum lengths of twenty primary particles selected at random.

Although the material for the transfer-promoting particles is not limited, inorganic particles having high hardness are preferred. Particles prepared by surface treatment and having a hydrophobicity of 30% or more are more preferred because they are less affected by temperature and humidity. A hydrophobicity of 40% or more further improves the particle characteristics.

Examples of inorganic particles include silicon dioxide (silica), titanium dioxide (titania), aluminum oxide (alumina), magnesium oxide (magnesia), tin oxide, strontium oxide, and cerium oxide. These inorganic particles may be used alone or in combination.

A typical method for imparting hydrophobic characteristics onto the particles is a chemical modification using a compound which reacts with or physically adsorbs onto the particles. Examples of such compounds are organic silicon compounds including hexamethylsilazane, trimethylsilane, trimethylchlorosilane, trimethylethoxysilane, dimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptanes, trimethylsilyl mercaptane, triorganosilyl acrylates, vinyldimethylacetoxysilane, dimethylethoxysilane, dimethyldimethoxysilane, diphenyldiethoxysilane, hexamethyldisiloxane, 1,3-divinyltetremethyldisiloxane, 1,3-diphenyltetremethyldisiloxane, and polydimethylsiloxanes having 2 to 12 siloxane units per molecule and having hydroxyl groups at both ends. These organic silicon compounds are used alone or in combination.

The hydrophobicity of the particles is determined as follows. One gram of the particles is placed into 100 ml of deionized water and the dispersion is mixed with a shaker for 10 minutes. The dispersion is allowed to stand for some time before the particles are separated from the aqueous layer. The aqueous layer is sampled and subjected to determination of transmittance at 50 nm. The hydrophobicity is calculated from the transmittance by the following equation:

$$\text{Hydrophobicity (\%)}=\{(\text{transmittance of aqueous layer in dispersion})/(\text{transmittance of deionized water})\}\times 100$$

Methods for loading the transfer-promoting particles into the intermediate transfer member are not restricted. It is important to control the conditions of the treatment such that the adhesive force of particles to the intermediate transfer member is within the above-described range. For example, a coating member, such as a brush or a roller using sponge or elastic rubber, is put into contact with the rotating intermediate transfer member while the transfer-promoting particles are fed to the contact position. Alternatively, an elastic blade may be put into contact with the rotating intermediate transfer member. In another method, a sheet such as a nonwoven sheet loading particles is wound halfway around the intermediate transfer member, and the intermediate transfer member is rotated while applying a tension. A wet process can also be used. For example, transfer-promoting particles are dispersed in a desired solvent, the dispersion is applied onto the surface of the intermediate transfer member by a spray or dipping process, and the solvent is evaporated.

The adhesive force of the particles is affected by constituent materials for the intermediate transfer member and particles, the rotation rate and time, the compression pressure, and the volume of the loaded particles. In the wet process, the adhesive force can be controlled by using a different type of solvent or adding a trace amount of binding component to the solvent.

The shape of the intermediate transfer member can be appropriately determined in accordance with the use. Examples of typical shapes include a drum shown in FIGS. 3 and 4, and a belt shown in FIGS. 5 and 6. The layer configuration of the intermediate transfer member is not limited; however, the contact angle between the surface layer of the intermediate transfer member and water must be in a range from 50° to 120°. In FIGS. 3 to 6, numeral 5 represents a roller-type intermediate transfer member, numeral 51 is a solid, cylindrical, conductive support, numeral 52 represents an elastic layer, numeral 54 represents a surface layer, numeral 53 represents an intermediate layer, numeral 55 represents a belt-type intermediate transfer member, numeral 56 represents transfer-promoting particles, and numeral 57 represents a seamless resin belt.

Materials used for the conductive support include metals and alloys, e.g. aluminum, iron, copper, and stainless steels; and conductive resins containing dispersed carbon or metal particles. The cylinder may be provided with a shaft at the pivot. or may be reinforced at the interior.

The intermediate transfer member in accordance with the present invention preferably has a surface layer in which a lubricant powder having high lubricity and water repellency is dispersed in a binder. It is preferable that the powdered lubricant has a particle size which is equal to or less than one half that of the toner and that the surface layer contains 20 percent by weight or more of the powdered lubricant. Any powdered lubricant can be used without limitation. Examples of preferable lubricant materials include fluorine rubbers and elastomers; graphite and fluorinated graphite and carbon; fluorine compounds, e.g. polytetrafluoroethylene (PTFE), polyvinylidene fluoride (PVDF), ethylene-tetrafluoroethylene copolymers (ETFE), and tetrafluoroethylene-perfluoroalkylvinylether copolymers (PFA); silicone compounds, e.g. silicone resins, rubbers and elastomers; and miscellaneous resins, e.g. polyethylene (PE), polypropylene (PP), polystyrene (PS), acrylic resins, polyamide resins, phenol resins, and epoxy resins. Among them, fluorine polymers, which have significantly high lubricity and water repellency, are particularly preferred.

Figure 6:
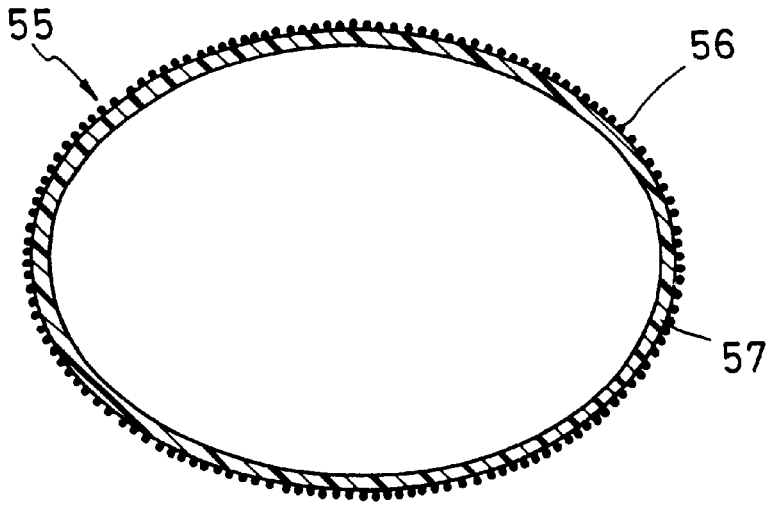
FIG. 6 is an enlarged cross-sectional view of a belt-type intermediate transfer member in accordance with the present invention.

As shown in FIG. 6, a resin seamless belt or a belt made by joining both ends of a resin sheet can be used as an intermediate transfer member. Fluorine resins and silicon resins having high lubricity are preferred as materials for such a belt.

Materials for the other segments of the intermediate transfer member in the present invention are not limited unless the materials cause deterioration of the surface characteristics. Examples of such materials include elastomers or rubbers and resins. Examples of the elastomers or rubbers include styrene butadiene rubbers, high styrene rubbers, butadiene rubbers, isoprene rubbers, ethylene-propylene copolymers, nitrile butadiene rubbers (NBRs), chloroprene rubbers, butyl rubbers, silicone rubbers, fluorine rubbers, nitrile rubbers, urethane rubbers, acrylic rubbers, epichlorohydrin rubbers, and norbornene rubbers. Examples of the resins include styrene resins, e.g. polystyrene, polychlorostyrene, poly-α-methylstyrene, styrene-butadiene copolymers, styrene-vinyl chloride copolymers, styrene-vinyl acetate copolymers, styrene-maleic acid copolymers, styrene-acrylate ester copolymers (e.g. styrene-methyl acrylate, styrene-ethyl acrylate, styrene-butyl acrylate, styrene-octyl acrylate, and styrene-phenyl acrylate), styrene-methacrylate ester copolymers (e.g. styrene-methyl methacrylate, styrene-ethyl methacrylate, and styrene-phenyl methacrylate), styrene-α-methyl chloroacrylate copolymers, and styrene-acrylonitrile-acrylate ester copolymers; and miscellaneous resins, e.g. polyvinyl chloride resins, rosin-modified maleic acid resins, phenol resins, epoxy resins, polyester resins, low molecular weight polyethylene, low molecular weight polypropylene, ionomers, polyurethane resins, silicone resins, ketone resins, ethylene-ethyl acrylate copolymers, xylene resins, fluorine resins, polycarbonate resins, polyamide resins, and polyvinyl butyral resins, and copolymers and mixtures thereof.

When the intermediate transfer member has an elastic layer, the elastic layer preferably has a thickness of 0.2 to 10 mm, and the surface layer preferably has a thickness of 3 to 100 μm and is composed of a material different from that for the elastic layer. An intermediate layer may be provided therebetween if necessary. When a resin belt is used as the intermediate transfer member, it preferably has a thickness of 30 to 300 μm.

The intermediate transfer member in accordance with the present invention has a resistance of $5\times10^4$ to $5\times10^9$ Ω. In order to control the resistance, a conductive material may be added in a desired amount unless the causes deterioration of the above-mentioned advantages. Examples of conductive materials include particulate inorganic conductive materials, carbon black, ionic conductive materials, conductive resins, and conductive particle-dispersed resins. Examples of materials for the particulate inorganic conductive materials include titanium oxide, tin oxide, barium sulfate, aluminum oxide, strontium titanate, magnesium oxide, silicon oxide, silicon carbide, and silicon nitride. These particulate inorganic conductive materials may be treated with tin oxide, antimony oxide or carbon if necessary. The shape of the inorganic conductive material can be spherical, fibrous, plate, or amorphous. Examples of ionic conductive materials include ammonium salts, alkyl sulfonates, phosphate salts, and perchlorate. Examples of conductive resins include methyl methacrylate, polyvinylaniline, polyvinylpyrrole, polydiacetylene, and polyethylene-imine, in which each resin contains a quaternary ammonium salt. In the conductive particle-dispersed resin, conductive particles of carbon, aluminum, and nickel are dispersed In a resin, such as polyurethane, polyester, a vinyl acetate-vinyl chloride copolymer, or polymethyl methacrylate.

The above-mentioned constituents can be mixed with and dispersed into the binding resin by any known method. Apparatuses suitable for the use of an elastomeric binder include a roll mill, a kneader, a Banbury mixer, and the like. Apparatuses suitable for a liquid binder include a ball mill, a bead mill, a homogenizer, a paint shaker, a nanomizer and the like.

The intermediate transfer member in accordance with the present invention is produced, for example, as follows. A metal roll is prepared as a cylindrical conductive support. An elastomeric layer composed of rubber or plastic is formed on the metal roll by melt processing, injection, dipping, spraying or the like. Next, a surface layer is formed on the elastic layer by melt processing, injection, dipping, spraying or the like. The resulting intermediate transfer member includes two layers including an elastomeric layer.

The belt-type intermediate transfer member can be produced by the following processes. A seamless belt is produced by cutting a tube which is prepared by extrusion of a resin material. A double-layered belt-type intermediate transfer member is produced as follows. An elastic belt is formed by extrusion and vulcanized, and then a surface layer is formed thereon by spray coating or dip coating. The single- or double-layered belt can also be prepared by centrifugal molding.

In the present invention, any cleaning process for the intermediate transfer member can be employed. For example, the residual toner is scraped from the intermediate transfer member with an elastic blade which touches with and detaches from the intermediate transfer member as disclosed in Japanese Patent Laid-Open Nos. 56-153357 and 5-303310. Alternatively, a bias voltage having a polarity reverse to the residual toner on the intermediate transfer member is applied to a fur brush, which can touch with and detach from the intermediate transfer member, to transfer the residual toner onto the fur brush, the toner on the fur brush is retransferred onto a bias roller such as a metal roller, and the toner on the bias roller is scraped away with a blade. In these cleaning methods, the cleaning member repeatedly scrubs the intermediate transfer member, hence abrasion of the intermediate transfer member and melt adhesion of the toner will easily occur. Thus, transfer characteristics deteriorate and the intermediate transfer member has a shortened life. In addition, since a cleaning unit using a fur brush requires a driver unit, a countermeasure to scattering of the toner is essential. As a result, the apparatus inevitably has a complicated configuration.

In order to decrease the load of the blade during the cleaning process, the residual toner on the intermediate transfer member is charged with a reverse polarity to the potential of the photosensitive member as the first image holding member to transfer the toner onto the photosensitive member by means of the electric field, as disclosed in Japanese Patent Laid-Open Nos. 4-340564 and 5-297739.

A simplified cleaning mechanism is proposed in Japanese Patent Laid-Open No. 1-105980, wherein a charger is provided to charge the residual toner on the intermediate transfer member with a reverse polarity to the discharged potential of the photosensitive member in order to retransfer the residual toner onto the photosensitive member.

Such a cleaning mechanism by an electric field decreases friction between the cleaner and the intermediate transfer member and causes a prolonged life of the intermediate transfer member. When concentrated or dense images, however, are transferred under high-temperature, high-humidity environments, the cleaning operations must be repeated several times, resulting in a significantly decreased throughput. Particularly, it is significantly difficult to clean the intermediate transfer member after a line image is formed by overlapping a plurality of colors in which a large amount of toner is transferred. Because high-temperature, high-humidity environments cause decreased charge of the toner and increased amount of water adsorbed to the intermediate transfer member. As a result. secondary transfer characteristics are deteriorated, cleaning characteristics by the electric field is deteriorated, and the residual toner after secondary transfer is insufficiently charged with the reverse polarity.

If cleaning is not completed, a part of the formed image will appear the next image (so-called positive ghost) or the image will flow.

An effective cleaning method not causing a decreased throughput includes the steps of imparting a reverse polarity of charge to the residual toner, and retransferring the toner onto the intermediate transfer member while transferring the toner image formed on the photosensitive member onto the intermediate transfer member (primary transfer). This method is achieved only by providing a means for charging the residual toner after the secondary transfer with a reverse polarity, and the residual toner is recovered with the cleaning unit of the photosensitive member. Such recovery can be simultaneously performed with the removal of the residual toner after the primary transfer, resulting in easy maintenance. Since the apparatus does not require a transfer unit and a container for the recovered toner, it can be miniaturized and its material and production costs can be reduced.

This method, however, has the following disadvantages. When a large amount of toner remains on the intermediate transfer member, insufficient cleaning may be performed. Further, the toner retransferred to the photosensitive member interferes with the primary transfer image, and the density of the image at the portion corresponding to the former image is decreased (so-called negative ghost).

The occurrence of the negative ghost depends on the quantity of charge with a reversed polarity, which moves when the residual toner after the secondary transfer is recovered by the photosensitive member. A large quantity of charge inhibits ordinary toner transfer and causes a decreased image density of the relevant position. Such a large quantity of charge is required for recovering a large amount of residual toner after secondary transfer or recovering the residual toner strongly adhered to the intermediate transfer member.

Since the intermediate transfer member in accordance with the present invention has a high secondary transfer efficiency and a low adhesive force, it is highly compatible with electric-field cleaning, and particularly, simultaneous primary transfer and cleaning.

It is preferable that 0.5 percent by weight of fine particles (hereinafter referred to as additive), based on the weight of the toner not having fine particle, with a size of 0.5 $\mu$m or less be adhered to the toner (developing agent) in accordance with the present invention. Further, it is preferable in order to maintain excellent transfer characteristics that at least one of the additives be composed of the same material as that of the transfer-promoting particles; however, in such a case, the size and the conditions of the surface treatment may be different from each other. Although the transfer-promoting particles on the intermediate transfer member are gradually consumed, only a small number of these particles are separated from the toner and remain on the intermediate transfer member. The particles also maintain both transfer and cleaning characteristics. As a result, high transfer characteristics are achieved over a long term. If the surface of the intermediate transfer member has insufficient releasability, the additives are accumulated and fixed onto the intermediate transfer member and will cause deterioration of the transfer characteristics; however, in the intermediate transfer member and the image forming apparatus in accordance with the present invention, an excessive number of particles are transferred onto the transfer member etc., hence no trouble will occur.

A typical example of the first image holding member used in the present invention is an electrophotographic photosensitive member, but it is not limited to this. Non-limiting examples of the second image holding member include paper and OHP sheets.

An image forming apparatus using the intermediate transfer member in accordance with the present invention will now be described.

FIG. 1 is an outlined cross-sectional view of a color image forming apparatus (a copying machine or a laser printer) by a simultaneous transfer and cleaning method. An elastic roller 5 having medium resistance is used as the intermediate transfer member, and a transfer belt 6 is used as a secondary transfer means. A drum-type electrophotographic photosensitive member 1 (hereinafter referred to as a photosensitive drum) as the first image holding member rotates at a given process speed in the direction of the arrow.

The rotating photosensitive drum 1 is charged by a primary charge roller 2 so as to have a given polarity and a given potential, and is exposed with exposing light 3 from an image exposing means not shown in the drawing (for example, a color decomposition and image-forming optical system of a color document, or a scanning exposing system by a laser scanner which outputs laser beams modulated in response to time-series digital pixel signals of the image information). A latent image corresponding to the first color component of the objective color image (for example, a yellow component image) is thereby formed.

The latent image is developed with a yellow toner Y as the first color from a first developer 41 (a yellow developer). Yellow, magenta, cyan and black developers 41 it to 44 rotate by rotation drivers not shown in the drawing in the direction of the arrow. Each developer is arranged so as to face the photosensitive drum 1 in the developing process.

The intermediate transfer member 5 rotates at a given speed in the direction of the arrow. The first yellow color toner image held on the photosensitive drum 1 is transferred onto the surface of the intermediate transfer member 5 by the electric field formed by the primary transfer bias which is applied from an electrical power source 14 to the intermediate transfer member, and by the pressure when the image passes through the nip section between the photosensitive drum 1 and the intermediate transfer member 5. Hereinafter this process is referred to as primary transfer. The primary transfer bias voltage has a reverse polarity to that of the toner. A second magenta toner image, a third cyan toner image, and a fourth black toner image are similarly overlapped onto the intermediate transfer member 5 to form an objective full-color image.

A transfer belt 6 is arranged parallel to the intermediate transfer member 5 so as to come into contact with the lower surface of the intermediate transfer member 5. The transfer belt 6 is supported by a bias roller 62 and a tension roller 61. A desired secondary transfer bias voltage is applied to the bias roller 62 through an electrical power source 7, and the tension roller 61 is grounded. The bias roller 62 and the tension roller 61 may be made of the same material or different materials.

The full-color image formed on the intermediate transfer member 5 is transferred onto a transfer member P as a second image holding member as follows. The transfer belt 6 is put into contact with the intermediate transfer member 5, and the transfer member P is fed to the nip between the intermediate transfer member 5 and the transfer belt 6 through a feeding cassette not shown in the drawing, a resist roller 11 and a guide 10 at a given timing, while a secondary transfer bias voltage is applied to the bias roller 62 thorough the electrical power source 7. Hereinafter this process is referred to as secondary transfer.

The transfer member P holding the transferred toner image is heated in the fixer 13 to fix the toner image. After completing the transfer, the residual toner on the intermediate transfer member 5 is removed by applying a given bias voltage to a cleaning roller 8 through a bias electrical source 9. The cleaning roller 8 includes an elastic layer 82 and a coating layer 83. Numeral 12 represents a cleaner for the photosensitive drum.

In the primary process, the transfer belt 6 and the cleaning roller 8 are detached from the intermediate transfer member 5.

Cleaning of the intermediate transfer member will now be described in more detail. This embodiment is characterized by simultaneous primary-transfer/cleaning, that is, with primary transfer from the photosensitive drum to the intermediate transfer member, the residual toner after secondary transfer is retransferred onto the photosensitive drum. The mechanism is as follows. In the secondary transfer process, most of the residual toner is charged with a reversed polarity, i.e., positive polarity, to the regular polarity, i.e., negative polarity of the fresh toner; however, the entire toner is not always charged with the positive polarity. Thus, there are some toners, which are neutralized or negatively polarized. Since these toners are not completely transferred to the photosensitive drum in the cleaning process without additional treatment, they cause a ghost on the next printed image in a continuous printing process. If a transfer bias voltage higher than the optimized voltage is applied, the image deteriorates by an excessive current flow and thus no high definition image is obtained.

Figure 7:
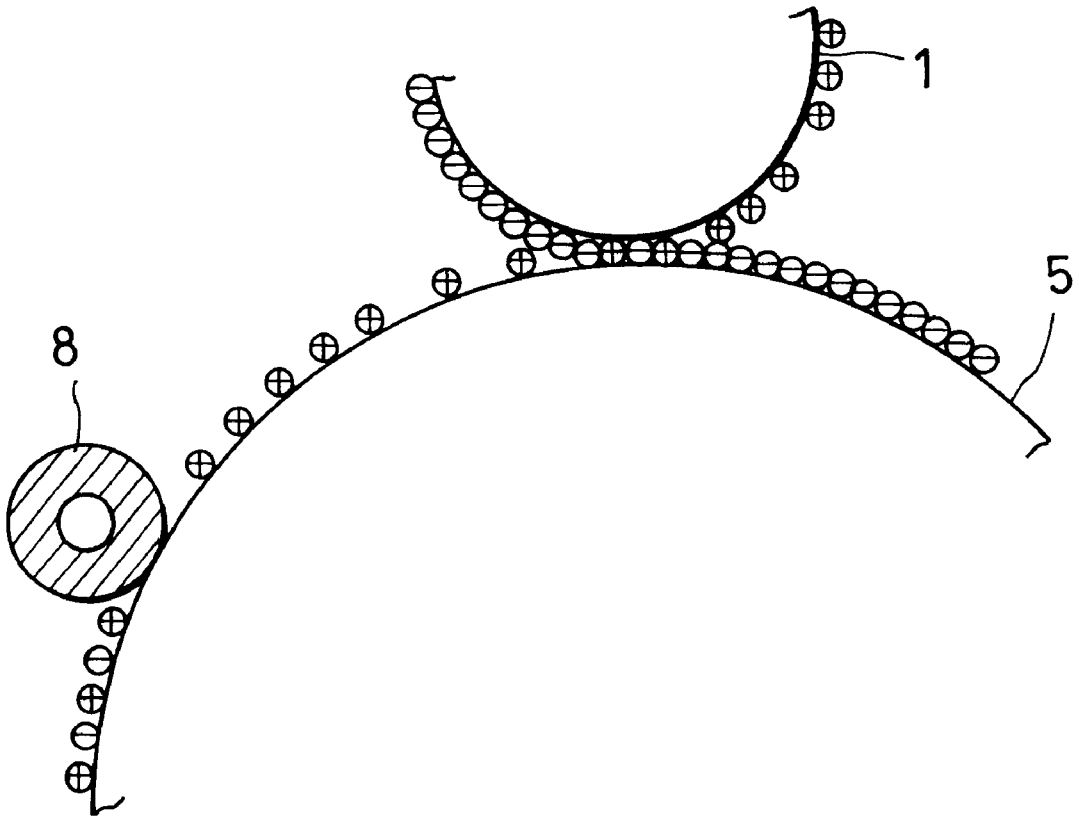
FIG. 7 is a cross-sectional schematic view illustrating primary transfer and simultaneous cleaning of an intermediate transfer member.

In this invention, a charging means for uniformly charging neutralized or negatively polarized toners to a reversed polarity after the secondary transfer is provided, so that the charged toners are retransferred to the photosensitive member with the primary transfer. FIG. 7 is a schematic view of the primary transfer in accordance with the present invention.

A typical example of the residual toner charging means is a contact-type-cleaning roller, that is, an elastic roller having several layers. The elastic roller used in this embodiment has a resistance of $6\times10^8$ Ω.

The present invention will now be described in more detail with reference to the following Examples. In these Examples, "pbw" refers to parts by weight and the formulations are based on one hundred parts.

EXAMPLE 1

A rubber sheet was prepared by extrusion from a compound having the following formulation and adhered onto an aluminum cylindrical roller with a diameter of 182 mm, a length of 320 mm and a thickness of 3 mm to obtain a roller A having an elastic layer with a thickness of 5 mm. The resistance of the rubber roller when a voltage of 1 kV was applied was $9\times10^5$ Ω.

| | |
|---|---|
| NBR | 35 pbw |
| Epichlorohydrin rubber | 65 pbw |
| Paraffin oil | 2 pbw |
| Calcium carbonate | 12 pbw |
| Vulcanizing agent | 2 pbw |
| Vulcanization activator | 2 pbw |
| Vulcanization accelerator | 3 pbw |

A coating having the following formulation was prepared.

| | |
|---|---|
| Dimethylformamide (DMF) solution of polyester polyurethane (solid component: 20%) | 100 pbw |
| Ethyl acetate Solution of isocyanate trimer (solid component: 75%) | 4 pbw |
| Organometallic catalyst | 0.04 pbw |
| PTFE powder (particle size: 0.3 μm) | 37 pbw |
| Dispersing agent | 1.8 pbw |
| Cyclohexanone | 100 pbw |

The coating was applied onto the surface of a roller by spraying, and heated at 80° C. for 1 hour and then at 120° C. for 2 hours to remove the solvent and to promote curing. A surface layer with a thickness of 15 μm was thereby formed. The contact angle between the surface layer and water was 102°. The roller was provided with the surface layer was used as an intermediate transfer member.

The rotating intermediate transfer member was put into contact with a rotating fur brush, and hydrophobic silica particles (particle size: 0.007 μm; hydrophobicity: 98%) were supplied to the contact section to prepare an intermediate transfer member with silica transfer-promoting particles thereon. The adhesive force of the transfer-promoting particles was evaluated by the above-mentioned method, and the removal rate was 71%.

The intermediate transfer member was assembled in a laser printer of a configuration shown in FIG. 1. The contact pressure of the intermediate transfer member 5 to the photosensitive drum 1 was 9 kgf, the contact pressure of the cleaning roller 8 to the intermediate transfer member 5 was 1 kgf, and the contact pressure of the transfer belt 6 to the intermediate transfer member 5 was 3.5 kgf.

Conditions in the printing process were as follows:

Dark part potential Vd (potential of a non-image section after primary charging on the photosensitive drum): −580 V Light part potential Vl (potential of an image section after laser exposure on the photosensitive drum): −150 V Development method: nonmagnetic monocomponent jumping development Toner: Nonmagnetic monocomponent toner with a mean particle size of 6.8 μm containing 1.2 percent by weight of silica used for the intermediate transfer member which was mixed with the toner by a dry process Development bias voltage and frequency: −400 V for Vdc, 1,600 $V_{pp}$, (frequency: 1800 Hz) for Vac.

Process speed: 120 mm/sec

Primary transfer bias voltage: +150 V

The bias voltage applied to the cleaning roller was varied to an optimized voltage (An AC voltage was superimposed on a DC voltage).

Three printed images of a size-A3 document image were obtained by a continuous printing process under a N/N environment (23° C. and 60% RH) and a H/H environment (30° C. and 80% RH). The document image was composed of horizontal lines having a width of 1 mm and an interval of 20 mm, and each of the vertical lines was formed of a magenta line and a cyan line overlapping with each other. After this process, another document image composed of vertical lines with a thickness of 0.2 mm and an interval of 1 mm was subjected to printing using the same colors. Satisfactory printed images without a negative ghost and cleaning defects were obtained by printing tests under both environments. Further, a size-A3 document with an image pattern of a printed ratio of 5% was subjected to a continuous 10,000 printing process. Then, the above-mentioned printing tests were repeated again. Satisfactory printed images were also obtained. No crack or toner melt-adhesion was observed on the intermediate transfer member. Excellent cleaning characteristics and durability were confirmed.

EXAMPLE 2

An intermediate transfer member was prepared and printing tests were performed as in Example 1, while transfer-promoting particles were changed to titania having a particle size of 0.05 μm and a hydrophobicity of 60%, and the additive for the developer was changed to 0.9 percent by weight of silica and 0.3 percent by weight of titania. The removal rate was 63%. Satisfactory results were obtained as shown in Table 1.

EXAMPLE 3

An intermediate transfer member was prepared and printing tests were performed as in Example 1, while transfer-promoting particles were changed to alumina having a particle size of 0.06 μm and a hydrophobicity of 50%, and the additive for the developer was changed to 1.0 percent by weight of silica and 0.2 percent by weight of the alumina described above. The removal rate was 58%. Satisfactory results were obtained as shown in Table 1.

EXAMPLE 4

An intermediate transfer member was prepared and printing tests were performed as in Example 1, while transfer-promoting particles were changed to silica having a particle size of 0.2 μm and a hydrophobicity of 80%. The removal rate was 73%. Satisfactory results were obtained as shown in Table 1.

EXAMPLE 5

An intermediate transfer member was prepared as in Example 1, while the formulation of the coating was changed as follows. The surface of the intermediate transfer member had a contact angle of 68°. The removal rate was 55%.

| | |
|---|---|
| DMF solution of polyester polyurethane (solid component: 20%) | 100 pbw |
| Ethyl acetate solution of isocyanate trimer (solid component: 75%) | 4 pbw |
| Organometallic catalyst | 0.04 pbw |
| PTFE powder (particle size: 0.3 μm) | 15 pbw |
| Dispersing agent | 1 pbw |
| Cyclohexanone | 15 pbw |

Printing tests were performed as in Example 1. A slight negative ghost was found at the initial stage under a H/H environment. The results are shown in Table 1.

EXAMPLE 6

An elastic seamless belt with a diameter of 185 mm, a length of 320 mm, and a thickness of 1.2 mm was prepared by extrusion from a compound having the following formulation.

| | |
|---|---|
| NBR | 45 pbw |
| EPDM | 65 pbw |
| Conductive carbon black | 10 pbw |
| Paraffin oil | 10 pbw |
| Calcium carbonate | 7 pbw |
| Vulcanizing agent | 2 pbw |
| Vulcanization activator | 2 pbw |
| Vulcanization accelerator | 3 pbw |

The elastic belt was dipped into the coating of Example 1, and heated at 80° C. for 30 min. and then at 120° C. for 2 hours to remove the solvent and to promote curing. A surface layer with a thickness of 20 μm was thereby formed. The elastic belt provided with the surface layer was used as an intermediate transfer member. The belt was driven by an aluminum core bar to apply silica particles on the surface of the belt as in Example 1. The removal rate was 70%.

Figure 2:
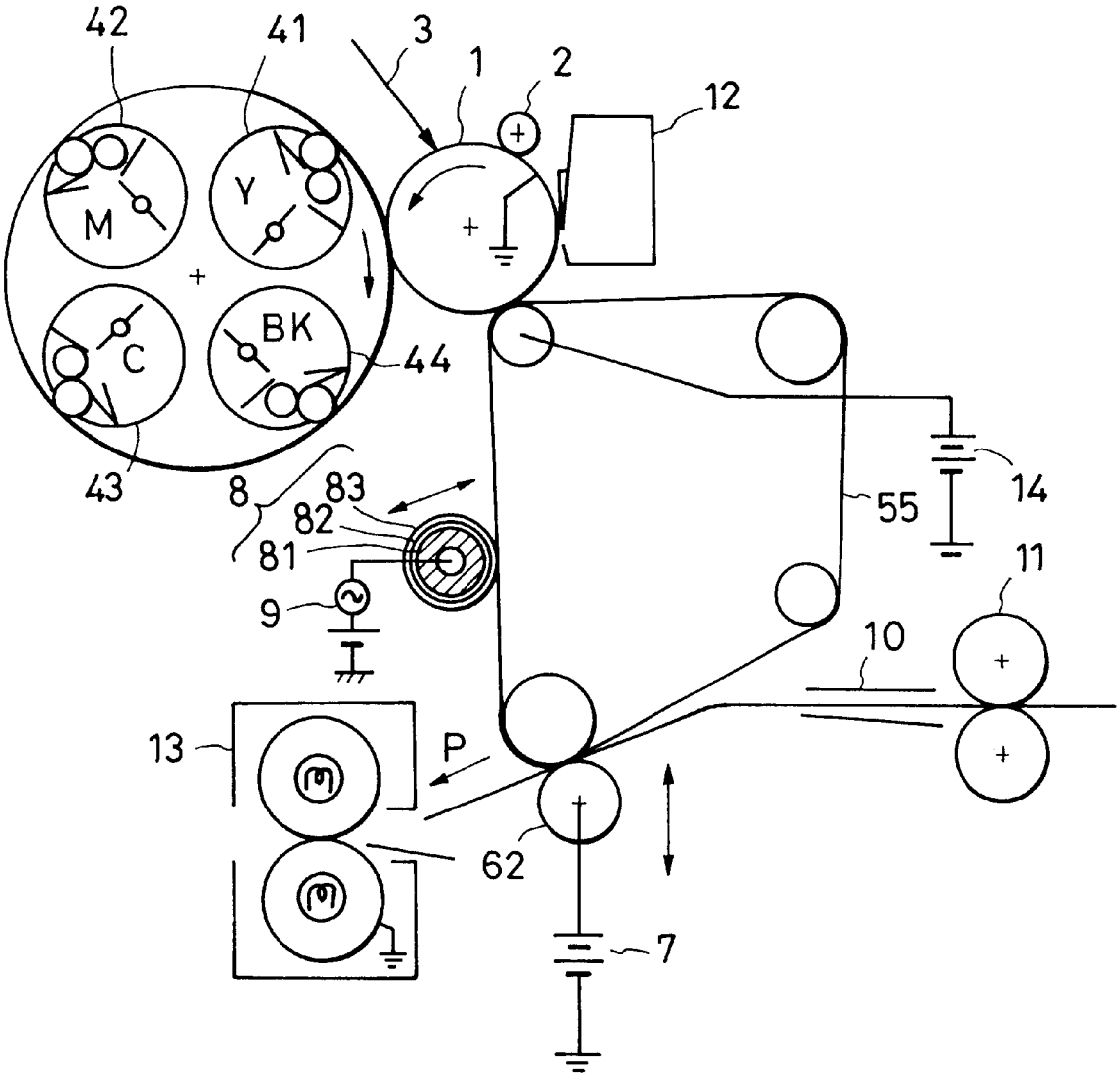
FIG. 2 is an outlined cross-sectional view of an image forming apparatus provided with a belt-type intermediate transfer member in accordance with the present invention.
Figure 3:
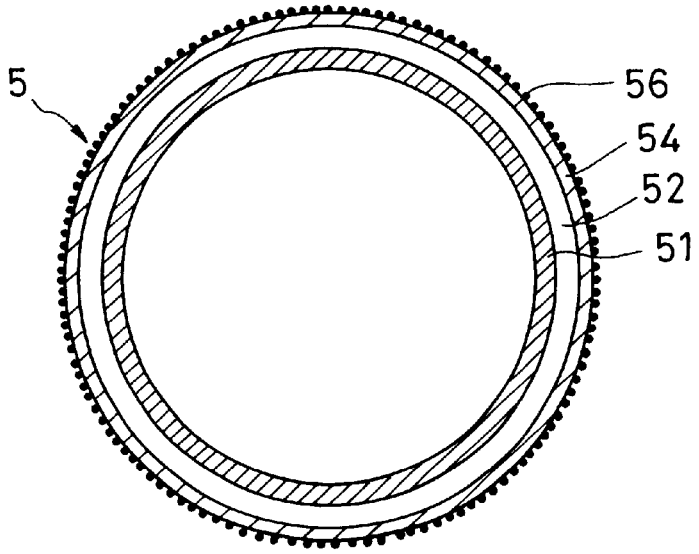
FIG. 3 is an enlarged cross-sectional view of a roller-type intermediate transfer member in accordance with the present invention.
Figure 4:
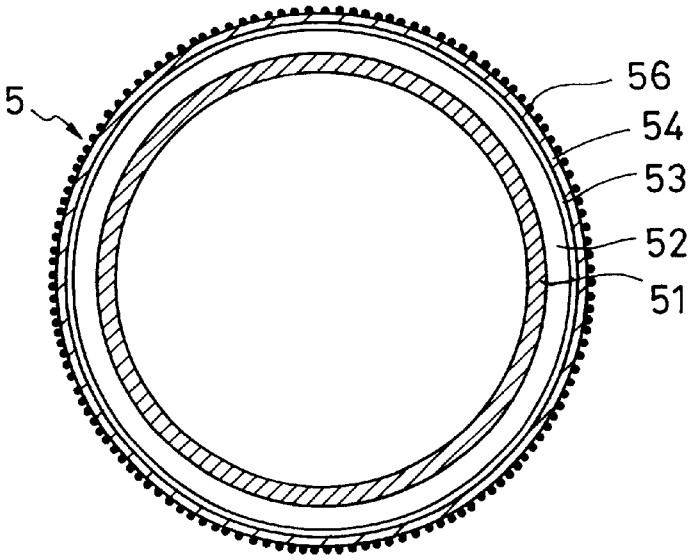
FIG. 4 is an enlarged cross-sectional view of a roller-type intermediate transfer member in accordance with the present invention.
Figure 5:
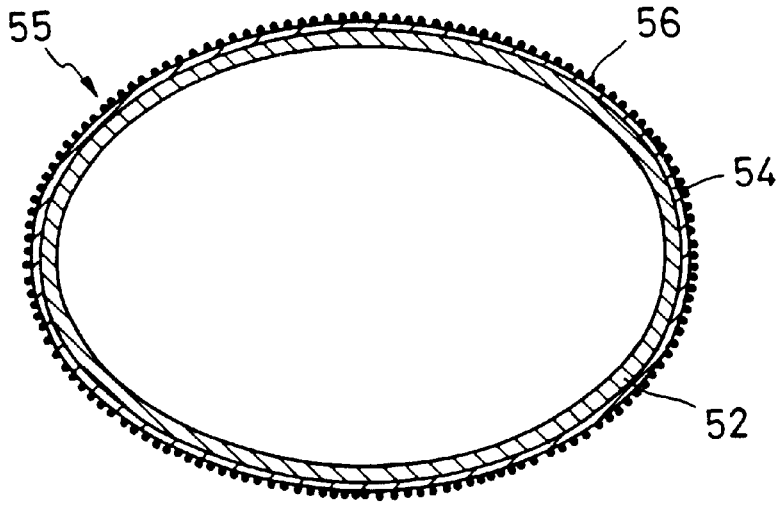
FIG. 5 is an enlarged cross-sectional view of a belt-type intermediate transfer member in accordance with the present invention.

The intermediate transfer member was assembled in a laser printer of a configuration shown in FIG. 2 and subjected to printing tests as in Example 1. A roller for driving the intermediate transfer belt, a tension roller, and transfer roller had diameters of 60 mm or more so as to suppress damage of the intermediate transfer member by bending of the rollers. Satisfactory printed images without a negative ghost and cleaning defects were obtained at the initial stage of the printing tests. Further, a size-A3 full-color document was subjected to a continuous 10,000 printing tests. Satisfactory printed images without a negative ghost and cleaning defects were also obtained. No problem caused by cleaning was observed on the intermediate transfer member. The results are shown in Table 1.

EXAMPLE 7

A resin sheet was obtained by kneading and forming a compound having the following formulation:

| | |
|---|---|
| Fluorinated terpolymer | 100 pbw |
| Conductive carbon black | 5 pbw |

A resin belt with a diameter of 185 mm, a length of 320 mm and a thickness of 0.2 mm was prepared by bonding both ends of the resin sheet.

An intermediate transfer member of a single-layer resin belt, in which silica particles were applied to the surface, was prepared as in Example 6. The removal rate was 88%. Printing tests were performed using the intermediate transfer member as in Example 6. A negligible extent of negative ghosts and cleaning defects in practical view were observed mainly under the H/H environment. Cracks were slightly observed in the edge of the intermediate transfer member after durability test. The results are shown in Table 1.

EXAMPLE 8

An intermediate transfer member having a removal rate of 82% was prepared as in Example 6, but magnesia having a particle size of 0.6 $\mu$m and a hydrophobicity of 90% was used as transfer-promoting particles and a sponge roller was used as a particle supplier. Satisfactory results were obtained by printing tests using the intermediate transfer member according to the procedure in Example 6. The results are shown in Table 1.

EXAMPLE 9

An intermediate transfer member having a removal rate of 92% was prepared as in Example 6, but titania having a particle size of 0.3 $\mu$m and a hydrophobicity of 48% was used instead of the silica. The contact pressure of the fur brush was decreased in the coating process such that a larger amount of titania was fed and the resulting belt-type is intermediate transfer member had a small adhesive force to transfer-promoting particles. Printing tests were performed using the intermediate transfer member as in Example 6, negative ghosts and unsatisfactory cleaning were slightly observed from the initial stage under both environments. Further, in the durability test, negative ghosts and unsatisfactory cleaning were slightly observed under the H/H environment, and some cracks formed at the belt edge under the N/N environment. The results are shown in Table 1.

EXAMPLE 10

An intermediate transfer member having a removal rate of 31% was prepared as in Example 5, but silica having a particle size of 0.01 $\mu$m and a hydrophobicity of 50% was used. The silica particles were strongly wiped with a rubber solid roller into the intermediate transfer member in the supplying process such that a larger amount of silica was applied. Printing tests were performed using the intermediate transfer member as in Example 5, negative ghosts and unsatisfactory cleaning were slightly observed from the initial stage under both environments. Further, in the durability test, these defects other than unsatisfactory cleaning under the N/N environment were still observed. The results are shown in Table 1.

EXAMPLE 11

An intermediate transfer member, in which multilayered transfer-promoting particles were applied, was prepared by wet continuous application as follows. Five percent by weight of the silica particles used in Example 1 were mixed with acetone. Immediately after a surface layer was formed by spraying as in Example 1, the acetone/silica mixture was sprayed thereon, and dried cured by heat. The contact angle of the surface layer was 102° and the removal rate was 41%, when the surface of the intermediate transfer member was ground with a #1500 sanding paper. Satisfactory results were obtained from the printing tests using the intermediate transfer member according to Example 1, as shown in Table 1.

EXAMPLE 12

An intermediate transfer member was prepared as in Example 1, but magnesia with a particle size of 3.8 $\mu$m and a hydrophobicity of 85% was used. The intermediate transfer member had a removal rate of 73%. The intermediate transfer member was subjected to printing tests. Cleaning characteristics slightly deteriorated and negative ghosts are slightly observed at the initial stage under the H/H environment and cleaning characteristics slightly deteriorated under the N/N environment. Further, in the durability tests, cleaning characteristics slightly deteriorated under the H/H environment. The results are shown in Table 1.

COMPARATIVE EXAMPLE 1

An intermediate transfer member was prepared as in Example 5, but the transfer-promoting particles were not used. The intermediate transfer member showed unsatisfactory cleaning characteristics at the initial stage of the printing tests under the H/H environment. Unsatisfactory cleaning and negative ghosts were not eliminated at different cleaning voltages, and an optimum condition for an excellent image was not found. The durability tests were therefore not carried out. The results are shown in Table 1.

COMPARATIVE EXAMPLE 2

An intermediate transfer member was prepared as in Example 1, but no surface layer was provided on the elastic layer and silica was applied. The contact angle of the surface layer of the intermediate transfer member and water was 38° and the removal rate was 15%. The intermediate transfer member was subjected to printing tests. Cleaning characteristics significantly deteriorated from the initial stage under both N/N and H/H environments. Further, the resulting images had low densities and roughness. These disadvantages were not eliminated at different cleaning voltages, and an optimum condition for an excellent image was not found. The durability tests were therefore not carried out. The results are shown in Table 1.

TABLE 1

| | Contact angle (°) | Particle Material | Particle size (μm) | Hydrophobicity (%) | Removal rate (%) | N/N environment Initial stage Cleaning | N/N environment Initial stage Ghost | N/N environment After testing Cleaning | N/N environment After testing Ghost | H/H environment Initial stage Cleaning | H/H environment Initial stage Ghost | H/H environment After testing Cleaning | H/H environment After testing Ghost |
|---|---|---|---|---|---|---|---|---|---|---|---|---|---|
| Example 1 | 102 | Silica | 0.007 | 98 | 71 | A | A | A | A | A | A | A | A |
| Example 2 | 102 | Titania | 0.05 | 60 | 63 | A | A | A | A | A | A | A | A |
| Example 3 | 102 | Alumina | 0.06 | 50 | 58 | A | A | A | A | A | A | A | A |
| Example 4 | 102 | Silica | 0.2 | 80 | 73 | A | A | A | A | A | A | A | A |
| Example 5 | 68 | Silica | 0.007 | 98 | 55 | A | A | A | A | A | A | B | A |
| Example 6 | 102 | Silica | 0.007 | 98 | 70 | A | A | A | A | A | A | A | A |
| Example 7 | 75 | Silica | 0.007 | 98 | 88 | A | A | A | B | B | B | B | B |
| Example 8 | 102 | Magnesia | 0.6 | 90 | 82 | A | A | A | A | A | A | A | A |
| Example 9 | 75 | Titania | 0.3 | 48 | 92 | B | B | A | A | B | B | B | B |
| Example 10 | 68 | Silica | 0.01 | 50 | 31 | B | B | A | A | B | B | B | B |
| Example 11 | 102 | Silica | 0.007 | 98 | 41 | A | A | A | A | A | A | A | A |
| Example 12 | 102 | Magnesia | 3.8 | 85 | 73 | B | A | A | A | B | B | B | A |
| Comp. Ex. 1 | 68 | — | — | — | — | A | A | — | — | C | C | — | — |
| Comp. Ex. 2 | 38 | Silica | 0.007 | 98 | 15 | C | C | — | — | C | C | — | — |

A: Excellent, B: Good, C: Not good

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising a first image holding member, and an intermediate transfer member for holding by primary transfer a toner image formed on said first image holding member and for retransferring by secondary transfer said transferred toner image onto a second image holding member, wherein a contact angle between a surface layer of said intermediate transfer member and water is 50° to 120°, and transfer-promoting particles are loaded onto said surface layer, and a removal rate of said transfer-promoting particles is 30% to 95%.

2. An image forming apparatus according to claim 1, wherein said image forming apparatus further comprises a cleaning means for recovering residual toner on said intermediate transfer member after said secondary transfer, said cleaning means being an electric field cleaning means.

3. An image forming apparatus according to either claim 1 or 2, wherein said contact angle is 60° to 110°.

4. An image forming apparatus according to either claim 1 or 2, wherein said transfer-promoting particles have a particle size of 0.001 μm to 3 μm.

5. An image forming apparatus according to claim 4, wherein said transfer-promoting particles have a particle size of 0.001 μm to 1 μm.

6. An image forming apparatus according to claim 5, wherein said transfer-promoting particles have a particle size of 0.005 μm to 1 μm.

7. An image forming apparatus according to either claim 1 or 2, wherein said transfer-promoting particles comprise inorganic particles.

8. An image forming apparatus according to either claim 1 or 2, wherein said transfer-promoting particles comprise the same material as that of an additive for a toner.

9. An image forming apparatus according to either claim 1 or 2, wherein said transfer-promoting particles have a hydrophobicity of not less than 30%.

10. An image forming apparatus according to claim 9, wherein said transfer-promoting particles have a hydrophobicity of not less than 40%.

11. An image forming apparatus according to claim 2, wherein said cleaning means is a primary transfer/cleaning means simultaneously performing primary transfer and cleaning.

12. An image forming apparatus according to either claim 1 or 2, wherein said intermediate transfer member has a drum shape.

13. An image forming apparatus according to either claim 1 or 2, wherein said intermediate transfer member has a belt shape.

14. An image forming apparatus according to either claim 1 or 2, wherein said first image holding member comprises an electrophotographic photosensitive member.

15. An image forming apparatus according to either claim 1 or 2, wherein said image forming apparatus is a full-color image forming apparatus.

16. An image forming method comprising the steps of:

a primary transfer step of transferring a toner image from a first image holding member onto an intermediate transfer member having a contact angle to water of 50° to 120° and having a surface layer provided with transfer-promoting particles loaded thereon, and a removal rate of said transfer-promoting particles is 30% to 95%; and a secondary transfer step of transferring the transferred toner image onto a second image holding member.

17. An image forming method according to claim 16, wherein said image forming method further comprises a cleaning step for recovering residual toner, using a cleaning means, on said intermediate transfer member after said secondary transfer, said cleaning means being an electric field cleaning means.

18. An image forming method according to either claim 16 or 17, wherein said contact angle is 60° to 110°.

19. An image forming method according to either claim 16 or 17, wherein said transfer-promoting particles have a particle size of 0.001 μm to 3 μm.

20. An image forming method according to claim 19, wherein said transfer-promoting particles have a particle size of 0.001 μm to 1 μm.

21. An image forming method according to claim 20, wherein said transfer-promoting particles have a particle size of 0.005 μm to 1 μm.

22. An image forming method according to either claim 16 or 17, wherein said transfer-promoting particles comprise inorganic particles.

23. An image forming method according to either claim 16 or 17, wherein said transfer-promoting particles comprise the same material as that of an additive for a toner.

24. An image forming method according to either claim 16 or 17, wherein said transfer-promoting particles have a hydrophobicity of not less than 30%.

25. An image forming method according to claim 24, wherein said transfer-promoting particles have a hydrophobicity of not less than 40%.

26. An image forming method according to claim 17, wherein said cleaning step is a primary transfer/cleaning step simultaneously performing primary transfer and cleaning.

27. An image forming method according to either claim 16 or 17, wherein said intermediate transfer member has a drum shape.

28. An image forming method according to either claim 16 or 17, wherein said intermediate transfer member has a belt shape.

29. An image forming method according to either claim 16 or 17, wherein said first image holding member comprises an electrophotographic photosensitive member.

30. An image forming method according to either claim 16 or 17, wherein said image forming method is a full-color image forming method.

31. An intermediate transfer member for holding by primary transfer a toner image formed on a first image holding member, and for retransferring by secondary transfer the transferred toner image onto a second image holding member, comprising:

a surface layer having a contact angle to water of 50° to 120°, and transfer-promoting particles loaded onto said surface layer, wherein a removal rate of said transfer-promoting particles is 30% to 95%.

32. An intermediate transfer member according to claim 31, wherein said contact angle is 60° to 110°.

33. An intermediate transfer member according to claim 31, wherein said transfer-promoting particles have a particle size of 0.001 $\mu$m to 3 $\mu$m.

34. An intermediate transfer member according to claim 33, wherein said transfer-promoting particles have a particle size of 0.001 $\mu$m to 1 $\mu$m.

35. An intermediate transfer member according to claim 34, wherein said transfer-promoting particles have a particle size of 0.005 $\mu$m to 1 $\mu$m.

36. An intermediate transfer member according to claim 31, wherein said transfer-promoting particles comprise inorganic particles.

37. An intermediate transfer member according to claim 31, wherein said, transfer-promoting particles comprise the same material as that of an additive for a toner.

38. An intermediate transfer member according to claim 31, wherein said transfer-promoting particles have a hydrophobicity of not less than 30%.

39. An intermediate transfer member according to claim 38, wherein said transfer-promoting particles have a hydrophobicity of not less than 40%.

40. An intermediate transfer member according to claim 31, wherein said intermediate transfer member has a drum shape.

41. An intermediate transfer member according to claim 31, wherein said intermediate transfer member has a belt shape.

42. An intermediate transfer member according to claim 31, wherein said first image holding member comprises an electrophotographic photosensitive member.

* * * * *

UNITED STATES PATENT AND TRADEMARK OFFICE

CERTIFICATE OF CORRECTION

PATENT NO. : 6,278,858 B1
DATED : August 21, 2001
INVENTOR(S) : Akihiko Nakazawa et al.

It is certified that error appears in the above-identified patent and that said Letters Patent is hereby corrected as shown below:

Column 1,
Line 25, "occur" should read -- occurrence --; and
Line 58, "la" should be deleted.

Column 5,
Line 6, "almost" should read -- almost all --.

Column 7,
Line 5, "pivot." should read -- pivot, --.

Column 8,
Line 23, "In" should read -- in --.

Column 10,
Line 64, "it" should be deleted.

Column 15,
Line 37, "is" should be deleted.

Column 16,
Line 24, "are" should read -- were --.

Column 20,
Line 17, "said," should read -- said --.

Signed and Sealed this

Twenty-sixth Day of February, 2002

*Attest:*

*Attesting Officer*

JAMES E. ROGAN
*Director of the United States Patent and Trademark Office*